US012698948B2

(12) United States Patent
Hampton et al.

(10) Patent No.: US 12,698,948 B2
(45) Date of Patent: Aug. 4, 2026

(54) AIMING DEVICE FOR FIREARM

(71) Applicant: EOTech, LLC, Plymouth, MI (US)

(72) Inventors: Aaron Hampton, Columbus, GA (US); Pyeongan Kim, Goyang-si (KR); Brian Socha, Dearborn, MI (US); Conor Eckler, New Hudson, MI (US)

(73) Assignee: EOTech, LLC, Plymouth, MI (US)

( * ) Notice: Subject to any disclaimer, the term of this patent is extended or adjusted under 35 U.S.C. 154(b) by 0 days.

(21) Appl. No.: 18/507,685

(22) Filed: Nov. 13, 2023

(65) Prior Publication Data

US 2024/0159500 A1 May 16, 2024

Related U.S. Application Data

(60) Provisional application No. 63/383,487, filed on Nov. 12, 2022.

(51) Int. Cl.
*F41G 1/36* (2006.01)

(52) U.S. Cl.
CPC ..... *F41G 1/36* (2013.01)

(58) Field of Classification Search
None
See application file for complete search history.

(56) References Cited

U.S. PATENT DOCUMENTS 4,385,834 A * 5/1983 Maxwell, Jr. ..... F41G 3/326 356/138
4,947,044 A * 8/1990 Pinson ..... G01S 17/04 250/342
6,190,022 B1 * 2/2001 Tocci ..... F21V 33/0064 362/555
6,363,648 B1 * 4/2002 Kranich ..... F41G 1/35 42/117
7,269,920 B2 * 9/2007 Staley, III ..... F41G 1/473 42/114
D586,874 S 2/2009 Moody et al.
7,753,549 B2 * 7/2010 Solinsky ..... F41G 1/35 42/15
7,988,688 B2 * 8/2011 Webb ..... A61N 5/0618 128/898
D672,005 S 12/2012 Hedeen et al.
8,407,927 B2 * 4/2013 Huber ..... F41G 1/38 359/405
D682,977 S 5/2013 Thummel et al.
D696,377 S 12/2013 Thummel
8,833,994 B2 * 9/2014 Nemeyer ..... G02B 6/0001 362/555
9,069,172 B1 * 6/2015 Morley ..... H01J 31/49
(Continued)

OTHER PUBLICATIONS

International Search Report & Written Opinion for Application No. PCT/US2023/079501; mailed Sep. 16, 2024; 11 pp.
Utility U.S. Appl. No. 18/507,685, filed Nov. 13, 2023; 30 pp.

*Primary Examiner* — Derrick R Morgan
(74) *Attorney, Agent, or Firm* — Bodman PLC

(57) ABSTRACT

An aiming device for a firearm comprising a housing and a near infrared illuminator. The near infrared illuminator is positioned in the housing and is configured to output near infrared light with adjustable beam divergence to provide a field of illumination that is adjustable. The near infrared illuminator includes a divergence adjustment input positioned on an upper side of the housing that is movable by a user to adjust the beam divergence.

22 Claims, 8 Drawing Sheets

(56) References Cited

U.S. PATENT DOCUMENTS

D746,405 S * 12/2015 Nemeyer ..... D22/109
D800,864 S 10/2017 Hartley
D846,690 S 4/2019 Cheng et al.
10,581,214 B2 * 3/2020 Lemire ..... F41G 1/35
11,162,761 B2 * 11/2021 Oliver ..... F41G 1/35
D983,305 S 4/2023 Liu
11,874,090 B2 * 1/2024 Teetzel ..... F41G 11/00
D1,056,115 S * 12/2024 Kim ..... D22/109
D1,079,884 S 6/2025 Sun et al.
D1,082,885 S 7/2025 Wright et al.
D1,090,768 S 8/2025 Cheng
D1,110,458 S 1/2026 Wright et al.
2008/0000133 A1 * 1/2008 Solinsky ..... F41G 1/35 42/114
2009/0223072 A1 * 9/2009 Morin ..... F41G 1/14 33/263
2009/0224154 A1 9/2009 Jancic et al.
2010/0275496 A1 11/2010 Solinsky et al.
2010/0283404 A1 * 11/2010 Thoren, Sr. ..... F41G 1/35 362/184
2011/0173822 A1 7/2011 Cranton et al.
2012/0063142 A1 * 3/2012 Cameron ..... G02B 26/005 362/277
2012/0327247 A1 * 12/2012 Mironichev ..... F41G 3/06 235/404
2013/0182739 A1 * 7/2013 Cheng ..... F41G 1/35 372/101
2013/0333184 A1 * 12/2013 Couture ..... F41G 11/003 29/428
2014/0317988 A1 * 10/2014 Battis ..... F41G 1/36 42/114
2015/0247703 A1 * 9/2015 Teetzel ..... G01S 17/08 356/5.01
2015/0369565 A1 * 12/2015 Kepler ..... G02B 27/106 348/143
2016/0010949 A1 1/2016 Teetzel et al.
2016/0102943 A1 * 4/2016 Teetzel ..... F41G 1/35 42/113
2017/0205194 A1 * 7/2017 Teetzel ..... F41G 1/26
2019/0360778 A1 11/2019 Oliver et al.
2022/0018632 A1 * 1/2022 Flaster ..... G02B 26/007
2022/0341708 A1 * 10/2022 Teetzel ..... F41A 35/02
2024/0035779 A1 2/2024 Teetzel et al.

* cited by examiner

AIMING DEVICE FOR FIREARM

CROSS-REFERENCE TO RELATED APPLICATION(S)

This application claims priority to and the benefit of U.S. Provisional Application No. 63/383,487, filed Nov. 12, 2022, the entire disclosure of which is incorporated by reference herein.

TECHNICAL FIELD

The present disclosure relates to aiming devices for firearms and, in particular, aiming devices that include lasers and/or illuminators.

BACKGROUND

Aiming devices for firearms may include one or more aiming lasers that may emit both visible light and near infrared light and may further include an illuminator that emits near infrared light with beam divergence that may be adjustable to be greater than that of the aiming lasers. Aiming devices of this type may be used, for example, by military and law enforcement personnel in hostile situations and environments. It would, therefore, be advantageous to provide aiming devices that, among other benefits, are configured ergonomically to provide easy and intuitive of operation of both the aiming lasers and the illuminator and adjustment of the beam divergence of the illuminator.

SUMMARY

Disclosed herein are implementations of aiming devices for firearms. In one implementation, an aiming device for a firearm comprising a housing and a near infrared illuminator. The near infrared illuminator is positioned in the housing and is configured to output near infrared light with adjustable beam divergence to provide a field of illumination that is adjustable. The near infrared illuminator includes a divergence adjustment input positioned on an upper side of the housing that is movable by a user to adjust the beam divergence.

The aiming device may further include a visible aiming laser, a near infrared aiming laser, and/or an on-device actuation input that is configured to receive an input from the user to operate the near infrared illuminator, the visible aiming laser, and/or the near infrared aiming laser. The on-device actuation input may be located on the upper side of the housing. The divergence adjustment input and the on-device actuation input may be both centrally-located on the upper side of the housing between a left side and a right side of the housing. The divergence adjustment input may include a lever that is rotatable in a range of motion of between approximately 90 and 180 degrees to adjust the beam divergence. The range of motion of the lever may be substantially symmetric about a line parallel with an axis of the near infrared light output by the near infrared illuminator. The near infrared illuminator may include a near infrared light source that outputs the beam of the near infrared light and may include a photodiode according to which the near infrared light source is operated to output the beam of the near infrared light with a desired power.

In an implementation, an aiming device for a firearm includes a visible light aiming laser, an infrared aiming laser, an infrared illuminator, a chassis, a divergence adjustment input, and an on-device actuation input. The visible light aiming laser outputs a beam of visible light. The infrared aiming laser outputs a first beam of near infrared light that is aligned with the beam of visible light. The infrared illuminator outputs a second beam of near infrared light with beam divergence that is adjustable. The chassis includes a base and a housing coupled to the base. The base is configured to mount to the firearm. The housing contains the visible light aiming laser, the infrared aiming laser, and the infrared illuminator. The divergence adjustment input is configured to receive a user input for adjusting the beam divergence of the second beam of near infrared light. The divergence adjustment input includes a slide that is movable to receive the user input. The on-device actuation input configured to receive another user input to operate the visible light aiming laser, the infrared aiming laser, and the infrared illuminator.

The slide may be a lever that is rotatably movable to receive the user input. The on-device actuation input may be a button that is pressable to receive the other user input. The lever and the on-device actuation input may be centrally positioned on an upper side of the housing away from the base. The on-device actuation input may be positioned toward a user relative to the lever. The infrared illuminator may include a light source, an adjustable optic that is movable relative to the light source to adjust the beam divergence, and an adjustment mechanism that extends between the divergence adjustment input and the adjustable optic to transfer force and movement therebetween to adjust the beam divergence. The divergence adjustment input may an upper portion with the slide configured as a rotatable lever, a middle portion that extends from the upper portion through the upper side of the housing, and a lower portion that extends into the housing and is radially offset relative to a rotational axis of the divergence adjustment input. The adjustment mechanism may be coupled to the lower portion of the divergence adjustment input and the adjustable optic of the infrared illuminator. The aiming device may include a photodiode according to which the light source is operated to output the second beam of the near infrared light with a desired power.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
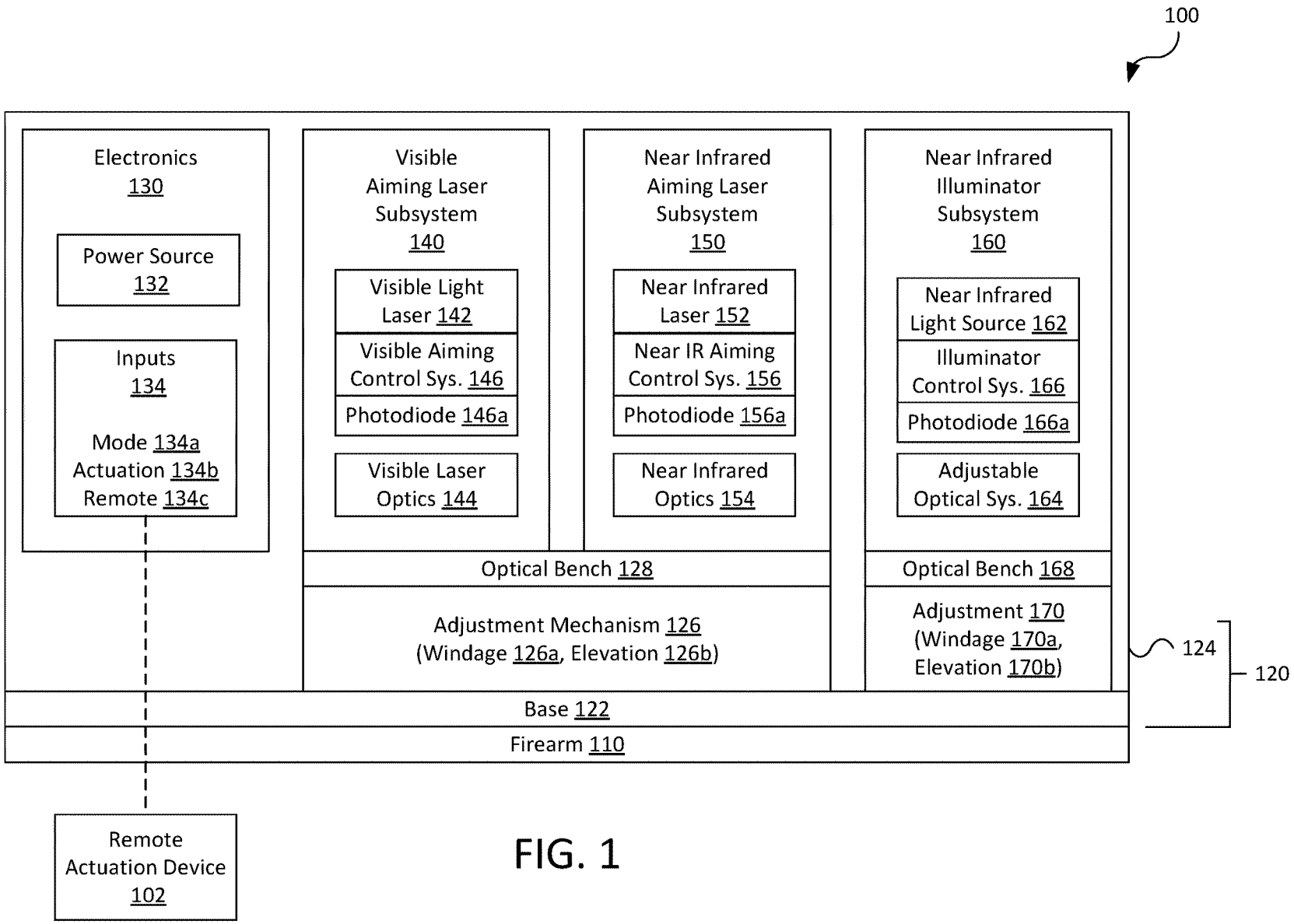
FIG. 1 is a schematic illustration of an aiming device coupled to a firearm.
Figure 2:
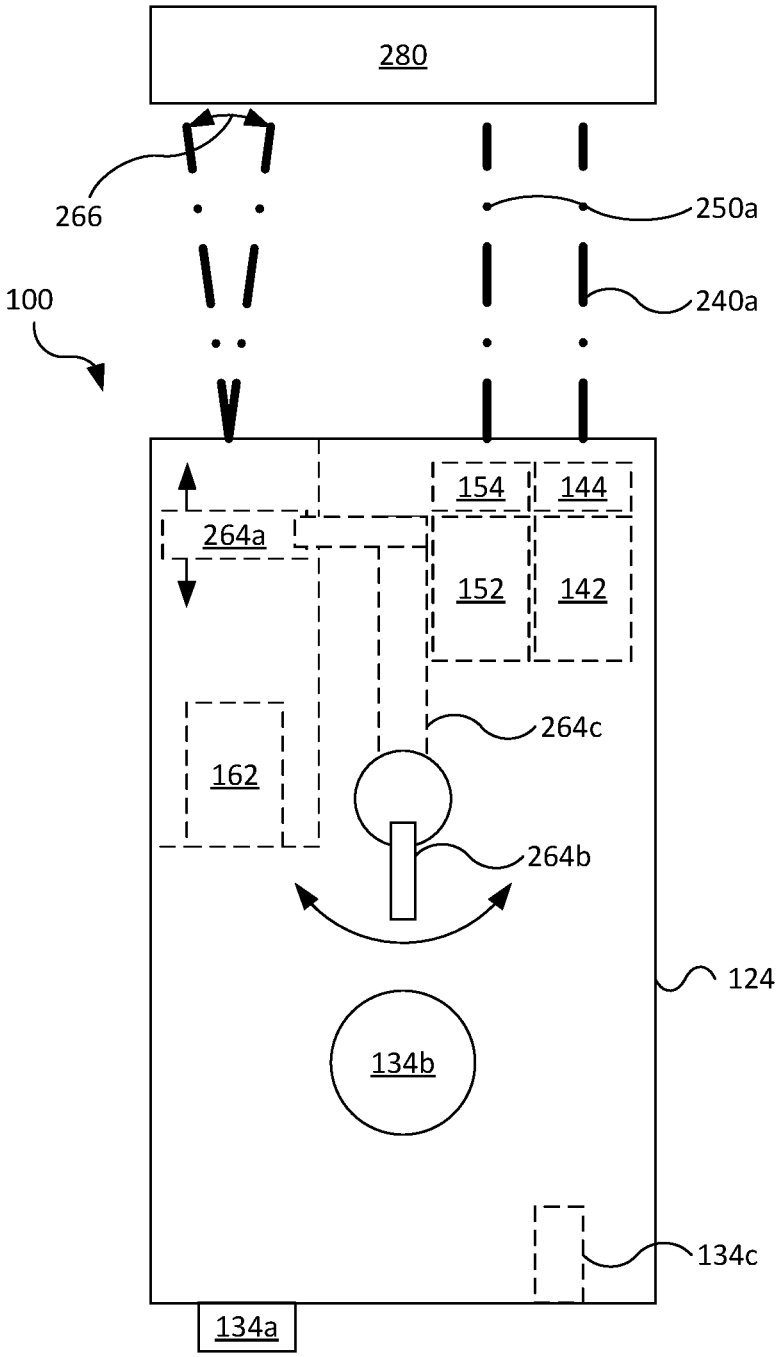
FIG. 2 is a simplified top view of the aiming device of FIG. 1 with hidden components depicted in dashed lines.
Figure 3:
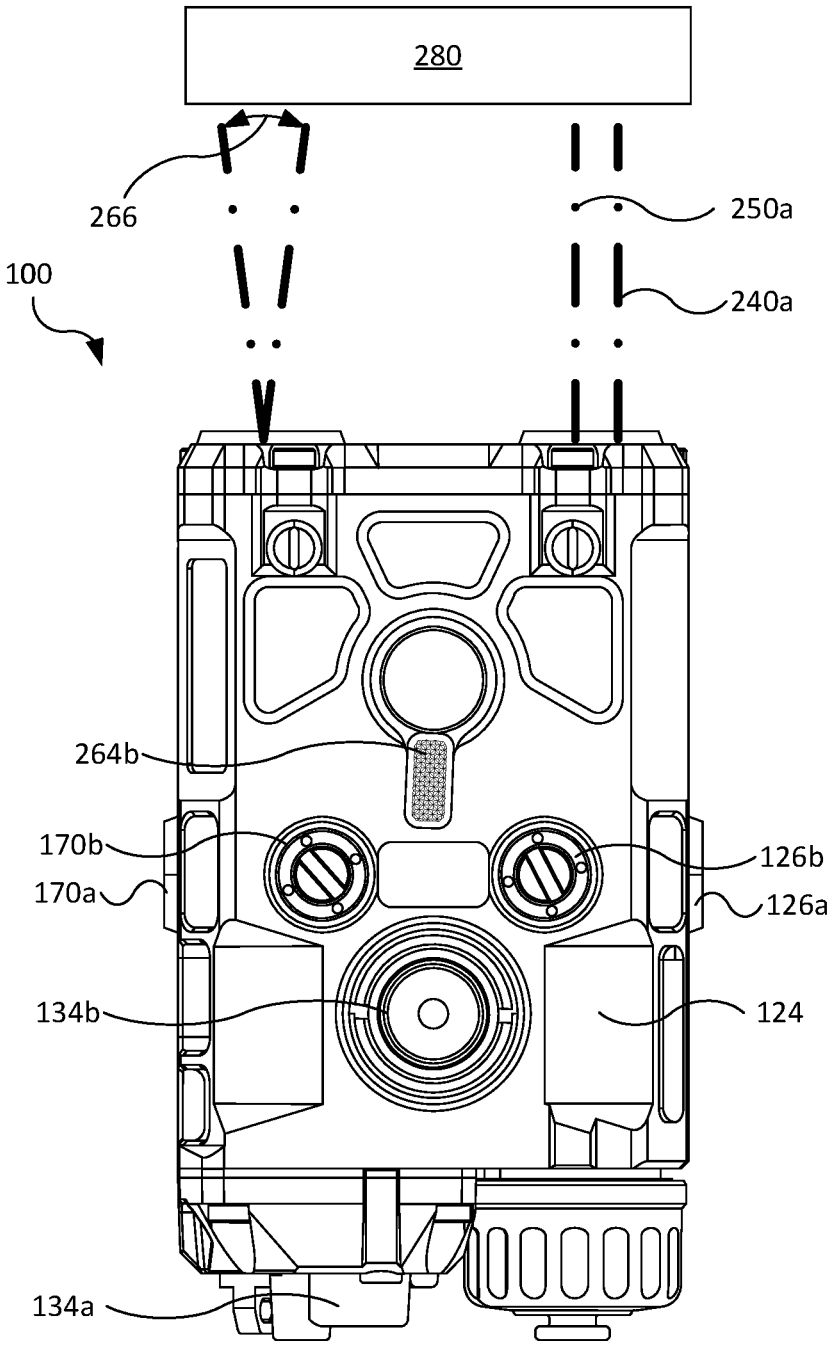
FIG. 3 is a top view of an embodiment of the aiming device.
Figure 4:
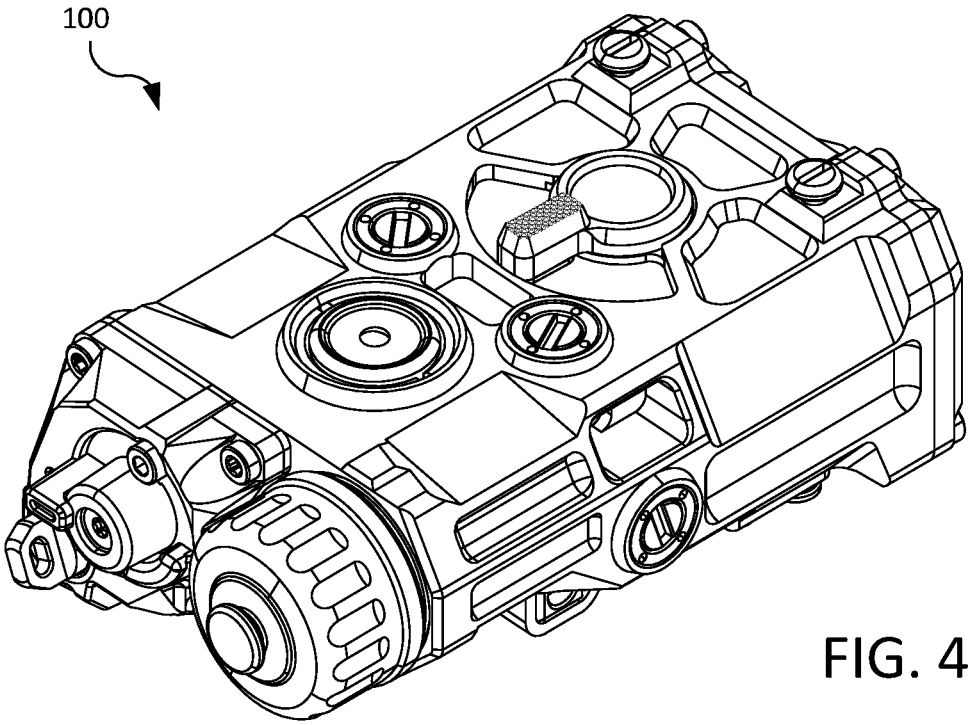
FIG. 4 is an upper, right, rear perspective view of the aiming device.
Figure 5:
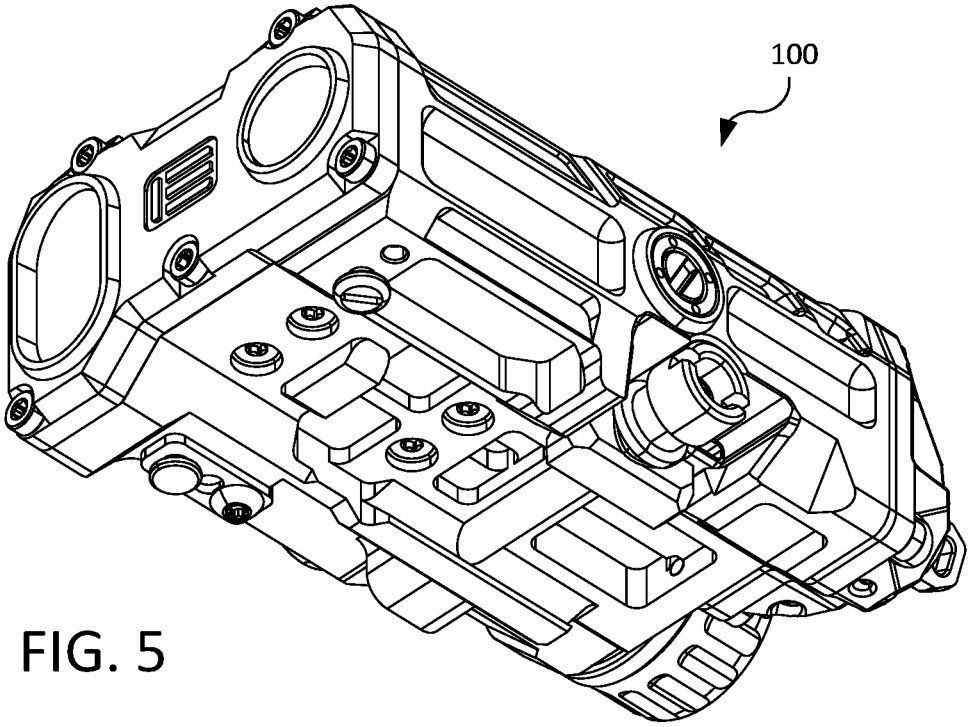
FIG. 5 is a lower, left, front perspective view of the aiming device.

Referring to FIGS. 1-2, an aiming device 100 is depicted schematically with interior components depicted in dashed lines in FIG. 2. Referring further to FIGS. 3-5, a specific embodiment of the aiming device 100 is illustrated.

The aiming device 100 is configured to mount to a firearm 110, such as a handgun, long gun, rifle, shotgun, carbine, machine gun, sniper rifle, submachine gun, or assault rifle. The aiming device 100 generally includes a chassis 120, electronics 130, a visible aiming laser subsystem 140, a near infrared aiming laser subsystem 150, and a near infrared illuminator subsystem 160.

The chassis 120 is configured to mount to the firearm 110 and contains, or otherwise has coupled thereto, the electronics 130, the visible aiming laser subsystem 140, the near infrared aiming laser subsystem 150, and the near infrared illuminator subsystem 160. The chassis 120, for example, includes a base 122, a housing 124, and an adjustment mechanism 126. The base 122 is coupleable to the firearm 110, for example, via one of various industry standardized mounting systems. The housing 124 may, for example, be formed of aluminum. The interior of the housing 124 may be waterproof according to any suitable standard. The housing 124 is coupled to the base 122 and defines an interior that contains therein various components of the electronics 130, the visible aiming laser subsystem 140, the near infrared aiming laser subsystem 150, and the near infrared illuminator subsystem 160. The adjustment mechanism 126 is configured to adjust the orientation one or more of the visible aiming laser subsystem 140, the near infrared aiming laser subsystem 150, and the near infrared illuminator subsystem 160 relative to the firearm 110 (e.g., for windage and elevation, as discussed in further detail below).

The electronics 130 are configured to provide power to and control the visible aiming laser subsystem 140, the near infrared aiming laser subsystem 150, and the near infrared illuminator subsystem 160. The electronics 130 include, for example, a power source 132, inputs 134, and various other electronic components to facilitate power transfer and control (e.g., a printed circuit board and various electronic components, for example, to control and/or condition power delivery and change between modes of operation based on the various inputs). The power source 132 may, for example, include one or more batteries. The inputs 134 are configured to receive inputs from the user for selecting different modes of operation and actuating the visible aiming laser subsystem 140, the near infrared aiming laser subsystem 150, and the near infrared illuminator subsystem 160.

The inputs 134 may, for example, include a mode selection input 134*a*, an on-device actuation input 134*b*, and/or a remote input 134*c*. The mode selection input 134*a* allows a user to select a mode of operation of the aiming device 100. Different modes of operation may, for example, include selecting different combinations of outputs (i.e., which of the subsystems 140, 150, 160 are operating) and power settings (e.g., output intensity of the subsystems 140, 150, 160). The mode selection input 134*a* may, for example, be configured as a knob that rotates between different positions at which one of the different modes of operation may be selected. The mode selection input 134*a* may include a lockout feature, such as a set screw, that prevents selection of various different modes (e.g., higher power settings that may not be eye safe), for example, by preventing rotation of the mode selection input 134*a*. The mode selection input 134*a* may, as shown in FIGS. 2-4, be positioned on a rear surface of the housing 124 facing the user during use. By positioning the mode selection input 134*a* on the rear surface of the housing 124 facing the user, the user may easily recognize the mode currently selected during use with their eyes positioned rearward of and looking toward the aiming device 100 (e.g., based on the position of the mode selection input 134*a* and any associated visual indices). Furthermore, positioning the mode selection input 134*a* on the rear surface of the housing 124 also declutters the upper side of the housing 124, which is more easily accessible to the user for other user inputs that the user may be inclined to use more frequently and/or during combat-type situations (e.g., to actuate the aiming device 100 and/or adjust illumination of the near infrared illuminator subsystem 160, as discussed in further detail below).

The on-device actuation input 134*b* allows a user to actuate the aiming device 100 according to the selected mode. The on-device actuation input 134*b* may, for example, be a depressible button that operates the aiming device 100 according to the mode selected with the mode selection input 134*a* while pressed by the user and/or after being pressed by the user multiple times in quick succession (e.g., until pressed again). As shown in FIGS. 2-4, the on-device actuation input 134*b* may be positioned on an upper side of the housing 124, for example, being biased toward a rear half of the housing 124 and/or being centrally-located approximately midway between left and right sides of the housing 124. By being positioned on the upper side of the housing 124, the on-device actuation input 134*b* is easily accessible to the user where they might normally position their support hand with their thumb on top of the firearm 110 and the aiming device 100 during use of the firearm 110 itself. The central positioning of the on-device actuation input 134*b* facilitates ambidextrous use thereof (e.g., whether the left or right hand of the user is used as their support hand).

The remote input 134*c* is connector configured to connect to a remote actuation input device 102. The remote input 134*c* may, for example, be a Crane-style connector. The remote actuation input device 102 may include a singular input (e.g., a depressible button) that operates the aiming device 100 in the same manner as the on-device actuation input 134*b* (e.g., operating the aiming device 100 according to the selected mode while pressed or after being pressed by the user multiple times in quick succession until pressed again).

The electronics 130 further include various devices and components (not shown) for providing power to and controlling the visible aiming laser subsystem 140, the near infrared aiming laser subsystem 150, and the near infrared illuminator subsystem 160.

The visible aiming laser subsystem 140 generally includes a visible light laser 142 and visible laser optics 144 that cooperatively output and focus a beam of visible light 240*a* that impinges on a target 280 as a singular point of the visible light. The beam of visible light is electromagnetic radiation in the visible light spectrum (e.g., being red or green), such as being green (e.g., between approximately 500 and 540 nanometers, such as approximately 520 nanometers). The visible light laser 142 may, for example, be a laser diode having a low power output of approximately 4 mW or less, high power output of 25 mW or less, and fixed beam divergence of approximately 0.5 milliradians (mrad) or less. The visible laser optics 144 may, for example, include one or more lenses arranged between the visible light laser 142 and the target 280 to filter or refract the visible light and/or protect the visible light laser 142. The visible aiming laser subsystem 140 may further include a control system 146 (e.g., visible aiming control system), which may regulate power supplied for consistent power output of the visible light by the visible light laser 142. The control system 146 may include a photo diode 146*a* and be configured with the visible light laser 142 as described below for the illuminator control system 166 and the photodiode 166*a* or variations thereof with the near infrared light source 162. For example, the control system 146 may be configured with suitable components to operate in an analog or a digital manner for the visible light aiming laser to output near the visible light (e.g. a visible laser beam) with a desired output power therefor.

The near infrared aiming laser subsystem 150 generally includes a near infrared laser 152 and near infrared laser optics 154 that cooperatively output and focus a beam of near infrared light 250*a* that impinges on the target 280 as another singular point of the near infrared light. The beam of near infrared light is electromagnetic radiation in the near infrared spectrum, such as between approximately 800 and 900 nanometers, such as approximately 840 nanometers. The near infrared laser 152 may, for example, be a laser diode. The visible light laser 142 may, for example, be a laser diode having a low power output of approximately 0.6 mW or less, high power output of approximately 35 mW or less, and fixed beam divergence of approximately 0.5 mrad or less. The near infrared laser optics 154 may, for example, include one or more lenses arranged between the near infrared laser 152 and the target 280 to filter and/or refract the near infrared light and/or protect the near infrared laser 152. The near infrared aiming laser subsystem 150 may further include a control system 156 (e.g., near infrared aiming (IR) control system), which may regulate power supplied for consistent power output of the near infrared light by the near infrared laser 152. The control system 156 may include a photo diode 156*a* and be configured with the visible light laser 152 as described below for the illuminator control system 166 and the photodiode 166*a* or variations thereof with the near infrared light source 162. For example, the control system 156 may be configured to operate in an analog or a digital manner for the near infrared aiming laser to output near the near infrared light (e.g. a near infrared laser beam) with a desired output power therefor.

The visible aiming laser subsystem 140 and the near infrared aiming laser subsystem 150 are aligned with each other and with the firearm 110, for example, such that the beam of visible light and the beam of near infrared light impinge on a target 280 at the point of impact (e.g., of a bullet or other projectile) at a predetermined distance from the firearm 110. For example, the visible light laser 142 and the near infrared laser 152 may be in fixed orientation to each other, for example, being fixedly coupled to a first optical chassis 128 and provided as a singular module. The first optical chassis 128 may also be referred to as an internal chassis, aiming laser chassis, or optical bench. The first optical chassis 128 is adjustable relative to the base 122 and, thereby, relative to the firearm 110 via the adjustment mechanism 126. The adjustment mechanism 126 may, for example, include a windage input 126*a* and an elevation input 126*b*, which are turned by the user to adjust the orientation of the visible light laser 142 and the near infrared laser 152 left-to-right and up-and-down, respectively, relative to a barrel of the firearm 110. The windage input 126*a* and the elevation input 126*b* may be configured to require use of a tool to provide input thereto (e.g., a screwdriver to turn the windage input 126*a* and the elevation input 126*b*), thus not being manipulable without a tool (e.g., directly by the fingers of the user).

The near infrared illuminator subsystem 160 generally includes a near infrared light source 162 and adjustable optical system 164, which cooperatively output a beam of near infrared light with beam divergence that is adjustable to provide a field of illumination 266 that is adjustable. The near infrared illuminator subsystem 160 is generally configured to be used in close-range (e.g., up to approximately 20 meters) and/or in enclosed environments (e.g., within buildings). The near infrared illuminator subsystem 160 may further include a control system 166 (e.g., an illuminator subsystem control system), which, as discussed in further detail below, may regulate power supplied for consistent power output of near infrared light by the near infrared light source 162.

The near infrared light source 162 and the adjustable optical system 164 are coupled to a second optical chassis 168, which is in turn adjustably mounted to the base 122 and, thereby, the firearm 110 by another adjustment mechanism 170. The optical chassis 168 may also be referred to as an internal chassis, illuminator chassis, or optical bench. The adjustment mechanism 170 may, for example, include a windage input 170*a* and an elevation input 170*b*, which are turned by the user to adjust the orientation of the near infrared illuminator subsystem 160 left-to-right and up-and-down, respectively to the barrel of the firearm 110. The windage input 170*a* and the elevation input 170*b* may be configured to require use of a tool to provide input thereto (e.g., a screwdriver to turn the inputs 170*a*, 170*b*), thus not being manipulable without a tool (e.g., directly by fingers of the user). The adjustment mechanism 126 and the adjustment mechanism 170 are operably independent of each other such that the orientation of the first optical chassis 128 (i.e., including the visible aiming laser subsystem 140 and the near infrared aiming laser subsystem 150) and the second optical chassis 168 (i.e., including the near infrared illuminator subsystem 160) are adjustable relative to the firearm 110 independent of each other.

The near infrared light source 162 may, for example, be a vertical-cavity surface-emitting laser (VCSEL) having a low power output of approximately 2.4 mW or less and a high power output of approximately 85 mW or less. As compared to other types of lasers, use of a VCSEL laser may allow for a more gradual transition from being brightly lit within the field of illumination 266 to being not lit outside the field of illumination 266 and/or have more visual uniformity (e.g., having a less grainy appearance).

The adjustable optical system 164 is configured to provide the near infrared illuminator subsystem 160 with an adjustable beam divergence to provide the field of illumination 266 that is adjustable. The field of illumination 266 may be adjustable, for example, between a minimum field of illumination with a beam divergence of between approximately 5 and 25 mrad (e.g., between approximately 10 and 20 mrad, such as approximately 15 mrad) and a maximum field of illumination 26 with a beam divergence of between approximately 80 and 130 mrad (e.g., between approximately 95 and 115 mrad, such as approximately 105 mrad). A ratio of the maximum field of illumination to the minimum field of illumination (e.g., the beam divergences thereof) may, for example, be between approximately 25:1 and 3:1, such as between approximately 10:1 and 5:1 or approximately 7:1.

The control system 166 of the near infrared illuminator subsystem 160, as referenced above, is configured to regulate power input to the near infrared light source 162 and, thereby, power of the near infrared light output thereby. Characteristics of the near infrared light source 162, such as the threshold current (i.e., current required to provide laser output) and the slope efficiency (i.e., output power versus input power), vary with temperature, such that a certain input current may result in no laser output or different power output at different temperatures. For the aiming device 100, contemplated use environments range in temperature from approximately −30 degrees Celsius to 60 degrees Celsius, which may result in no, unusable, or varied output from that expected by the user in such different environments.

The control system 166 may, for example, include a photodiode 166*a* according to which power (e.g., current) is supplied to the near infrared light source 162 to, thereby, regulate power (e.g., amplitude) of the near infrared light output by the near infrared light source 162. The photodiode 166*a* outputs a photocurrent (e.g., a light output current) according to the power of the near infrared light output by the near infrared light source 162 and detected by the photodiode 166*a*. The output of the photodiode 166*a* is then used to regulate or otherwise control the input power (e.g., current) to the near infrared light source 162 and, thereby, output of the near infrared light with a desired power. The control system 166 may be embodied entirely in hardware and be analog (e.g., without use of a microcontroller or other computational device), for example, including suitable circuitry (e.g., load resistor and amplifier) for driving input power to the near infrared light source 162 according to the output of the photodiode 166*a* to output the near infrared light such that the output of the photodiode 166*a* achieves a set value (e.g., within approximately 10, 5, 3 mW or less). The set value may be a current or voltage value that corresponds to desired power of the near infrared light output by the near infrared light source 162. The set value may, for example, correspond to desired power of the near infrared light of between 70 and 100 mW (e.g., between 75 and 90 mW, such as between 80 and 85 mW), or other suitable power of the near infrared light output by the near infrared light source 162. The set value may be configurable, for example, with the user being able to select (via an input) from between two different set values.

In alternative embodiments, the control system 166 may operate digitally, for example, converting the output of the photodiode 166*a* to a digital value according to which a microcontroller or other processor controls input power to the near infrared light source 162 to achieve the desired or set power output of the near infrared light.

The photodiode 166*a* may be incorporated into a common assembly with the near infrared light source 162, while the various analog and/or digital components are in electrical communication therewith (e.g., coupled a circuit board to which the photodiode 166*a* and the near infrared light source 162).

Figure 6A:
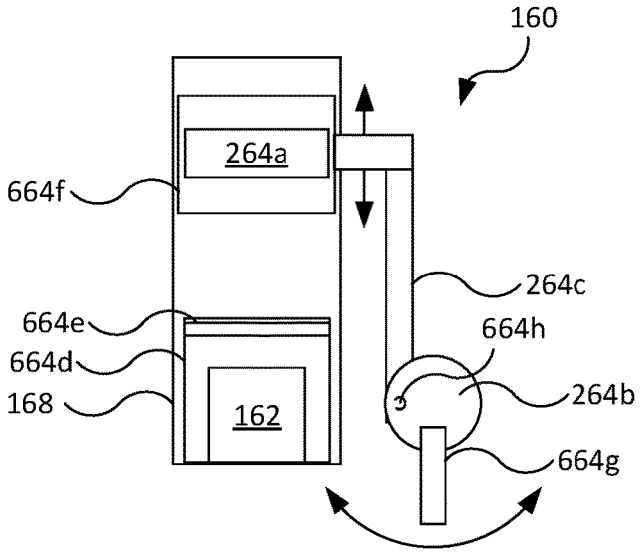
FIG. 6A is a simplified top view of a near infrared illuminator subsystem of the aiming device in a first configuration.
Figure 6B:
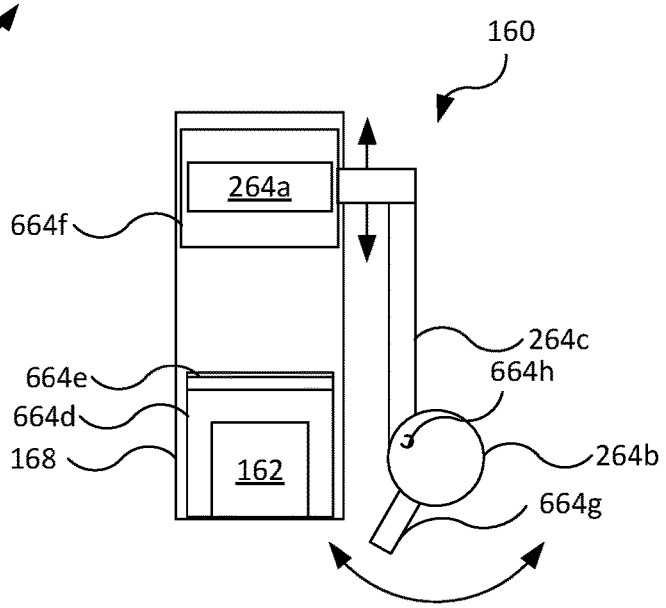
FIG. 6B is a simplified top view of a near infrared illuminator subsystem of the aiming device in a second configuration.
Figure 6C:
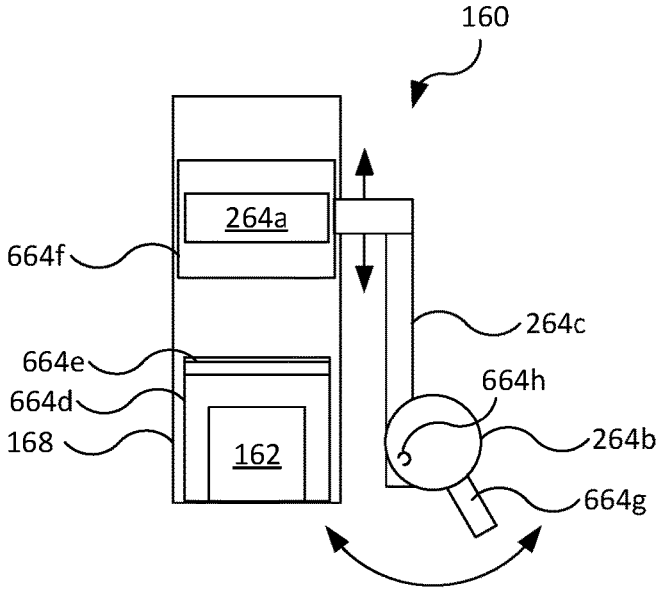
FIG. 6C is a simplified top view of a near infrared illuminator subsystem of the aiming device in a third configuration.

Still referring to FIG. 2 and additionally to FIGS. 6A-6C, the adjustable optical system 164 generally includes an adjustable optic 264*a* (e.g., a lens), a divergence adjustment input 264*b*, and an adjustment mechanism 264*c* that is configured to move the adjustable optic 264*a* relative to the near infrared light source 162 based on the divergence adjustment input 264*b* to adjust the beam divergence to provide the desired field of illumination 266. The adjustable optic 264*a* is a lens whose position is adjustable along an axis of the beam of near infrared light output of the near infrared light source 162 (e.g., the illuminator beam axis), so as to refract the near infrared light emitted by the near infrared light source 162 and change the beam divergence of the near infrared light emitted from the near infrared illuminator subsystem 160. The divergence adjustment input 264*b* is disposed on and is movable relative to the upper side of the housing 124 (e.g., rotationally and/or translationally). The adjustment mechanism 264*c* converts movement of the divergence adjustment input 264*b* into movement of the adjustable optic 264*a* (e.g., is moved by the divergence adjustment input 264*b* and, thereby, moves the adjustable optic 264*a* axially relative to the near infrared light source 162). Further aspects of the adjustable optical system 164 are discussed in further detail below.

The near infrared light source 162 is fixedly coupled to the second optical chassis 168. For example, the adjustable optical system 164 may further include a fixed bezel structure 664*d*, which is a generally tubular structure in which the near infrared light source 162 is fixedly coupled toward a rear end thereof and which in turn is fixedly coupled to the second optical chassis 168. The second optical chassis 168 may, for example, be configured as a tubular structure in which is received the fixed bezel structure 664*d*. A fixed lens 664*e* may also be fixedly coupled to the fixed bezel structure 664*d* at a forward end thereof between the near infrared light source 162 and the adjustable optic 264*a*. The fixed lens 664*e* may function to filter the near infrared light emitted by the near infrared light source 162, refract the near infrared light emitted by the near infrared light source 162, and/or otherwise protect the near infrared light source 162.

The adjustable optic 264*a* is movably coupled to the second optical chassis 168. For example, the adjustable optical system 164 may further include a movable bezel 664*f*, which is a generally tubular structure in which the adjustable optic 264*a* is fixedly coupled. The movable bezel 664*f* is positioned within a forward end of the second optical chassis 168 and is configured to slide axially therein (i.e., relative to the illuminator beam axis). The movable bezel 664*f* and the second optical chassis 168 may be further configured to prevent relative rotation therebetween.

In the example shown, the divergence adjustment input 264*b* is configured as a rotatable lever that is configured to be rotated (e.g., pivoted) by the user relative to the upper side of the housing 124. The divergence adjustment input 264*b* may, for example, include a slide configured as a lever 664*g* that extends radially outward from a central portion thereof and a rotational axis about which the divergence adjustment input 264*b* is rotated. The divergence adjustment input 264*b* (e.g., the lever 664*g* thereof) is configured to be operated by a user with a single finger pressing the lever

664*g*, as opposed to a conventional knob that must be grasped by two fingers (i.e., on either side thereof) in order to be rotated.

As shown in FIGS. 2-3, the divergence adjustment input 264*b* may be centrally-located on the upper side of the housing 124 approximately midway between left and right sides of the housing 124. The central positioning of the divergence adjustment input 264*b* facilitates ambidextrous use thereof (e.g., whether the left or right hand of the user). By being positioned on the upper side of the housing 124, the divergence adjustment input 264*b* is easily accessible to the user at a location in which the normally might normally position their support hand with their thumb on top of the firearm 110 and the aiming device 100 during use of the firearm 110 itself (e.g., as compared to a knob located on a front surface of the housing 124). The divergence adjustment input 264*b* may also be positioned forward of the on-device actuation input 134*b* (i.e., such that the on-device actuation input 134*b* is between the user and the divergence adjustment input 264*b*).

The lever 664*g* of the divergence adjustment input 264*b* may extend rearward toward the user and sweep through a range of motion (e.g., between 90 and 180 degrees, such as approximately 120 degrees or other suitable angular range) to adjust the beam divergence to provide the desired field of illumination 266. The range of motion of the lever 664*g* may be substantially symmetric toward left and right sides of the housing 124. For example, approximately half of the range of motion of the lever 664*g* may be toward each of the left and right sides of a center line of the housing 124 that is parallel with the illuminator beam axis.

As alternatives to the divergence adjustment input 264*b* being configured as a lever that is rotated, the divergence adjustment input 264*b* may be configured in other manners, for example, as a slide that moves translationally left-to-right or fore-aft with any suitable mechanism to transfer force and movement between the divergence adjustment input 264*b* and the adjustable optic 264*a* (e.g., a cam mechanism in the case of left-to-right movement or a fixed link in the case of fore-aft movement). In each case, the slide may be configured to be moved by a single finger of the user (i.e., without requiring being grasped between fingers) and may be positioned centrally (e.g., moving along the center line of the housing 124 and/or having a range of motion that is substantially equal on left and right sides of the center line).

Referring again to FIGS. 2 and 6A-6C, the adjustment mechanism 264*c* is configured as a rigid link that extends between and is coupled to the divergence adjustment input 264*b*. The adjustment mechanism 264*c* may, for example, extend generally forward and laterally from the divergence adjustment input 264*b* (e.g., from the central location thereof relative to the left and right sides of the housing 124) to the movable bezel 664*f* (e.g., to a laterally offset location of the near infrared illuminator subsystem 160 relative to the left and right sides of the housing 124). In other embodiments, the adjustment mechanism 264*c* may be configured in any other suitable manner to transfer force and movement from the divergence adjustment input 264*b* to the adjustable optic 264*a* (e.g., cams, linkages, etc.).

A first end of the adjustment mechanism 264*c* is coupled to a bottom protrusion 664*h* of the divergence adjustment input 264*b*, which extends generally downward relative to the lever 664*g* and into the housing 124. The bottom protrusion 664*h* is radially offset from a rotational axis about which the divergence adjustment input 264*b* (e.g., the lever 664*g*) rotates, such that rotation of the divergence adjustment input 264*b* about the rotational axis causes the first end the adjustment mechanism 264*c* to move in a generally axial direction (i.e., relative to the near infrared light emitted by from the near infrared light source 162).

A second end of the adjustment mechanism 264*c* is coupled to the movable bezel 664*f* As the adjustment mechanism 264*c* is moved by the divergence adjustment input 264*b* when rotated, the second end of the adjustment mechanism 264*c* applies force to the movable bezel 664*f* to cause the movable bezel 664*f* to move axially within the second optical chassis 168 between a forward position (shown in FIG. 6B) and a rearward position (shown in FIG. 6C) that may correspond the field of illumination 266 being narrow and wide, respectively.

The adjustment mechanism 264*c* may be coupled to the divergence adjustment input 264*b* and/or to the movable bezel 664*f* to provide compliance therebetween, such as rotational and/or radial compliance with the divergence adjustment input 264*b* and/or rotational compliance with the movable bezel 664*f*).

Figure 7A:
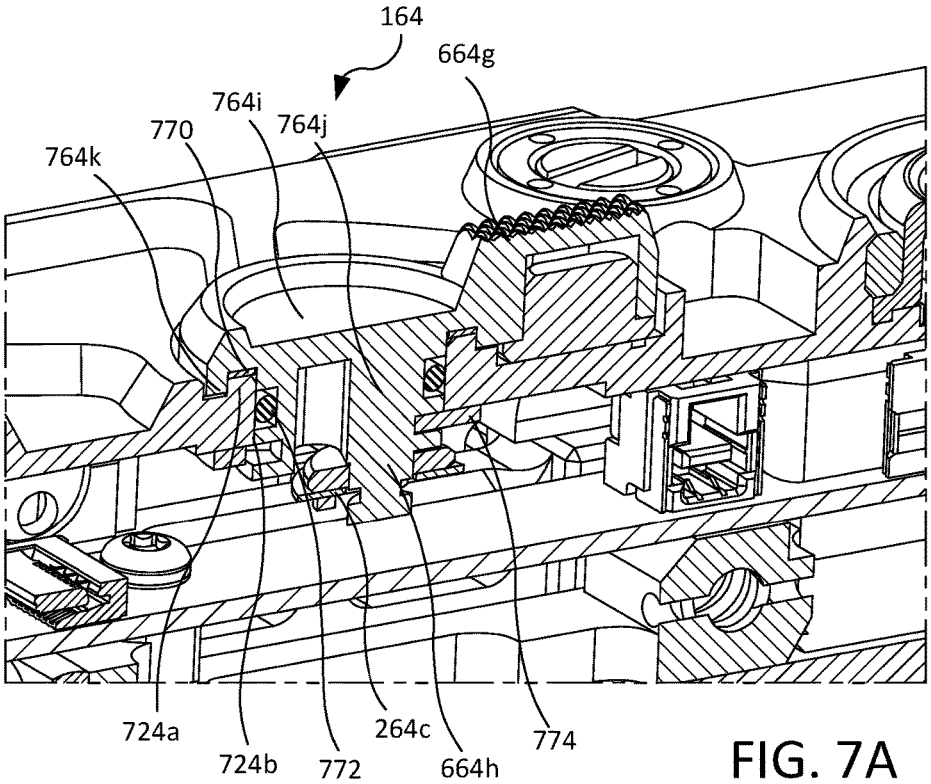
FIG. 7A is a partial cross-sectional view of the aiming device illustrating an adjustable optical system of the near infrared illuminator subsystem.
Figure 7B:
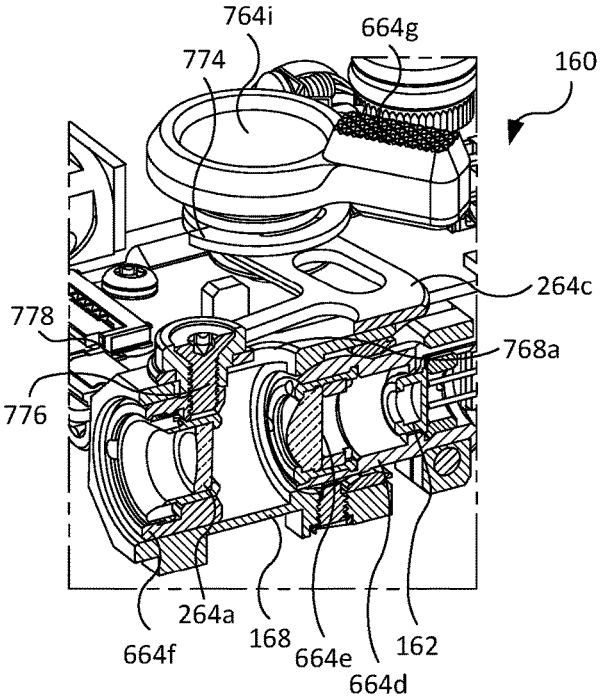
FIG. 7B is a partial cross-sectional view of the aiming device illustrating a near infrared light source and the adjustable optical system of the near infrared illuminator subsystem.
Figure 7C:
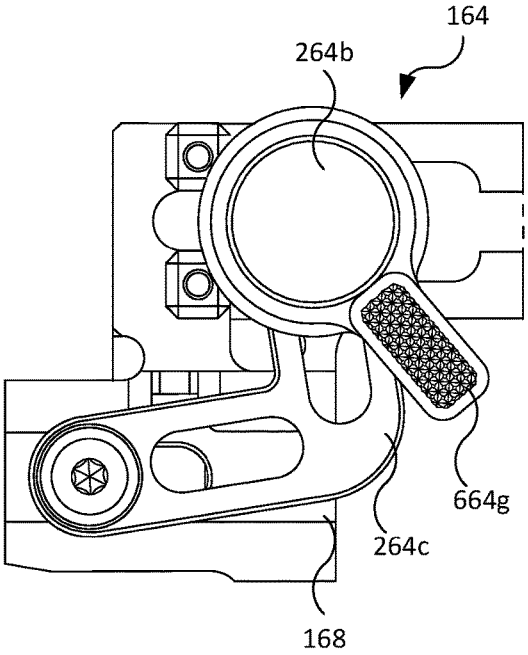
FIG. 7C is a partial top view of the adjustable optical system of the near infrared illuminator subsystem.

Referring further to FIGS. 7A-7C, further aspects of the adjustable optical system 164 are shown and described, including the divergence adjustment input 264*b*, the movable bezel 664*f*, and the adjustment mechanism 264*c*.

The divergence adjustment input 264*b* is configured to rotate about the rotational axis relative to the housing 124. The divergence adjustment input 264*b* further includes an upper portion 764*i* from which the lever 664*g* extends radially and a middle portion 764*j* that extends axially downward from the upper portion 764*i*. The upper portion 764*i* extends radially outward from the middle portion 764*j* and includes a bottom side that faces toward an upper surface of the upper side of the housing 124. To constrain the divergence adjustment input 264*b* radially relative to the housing 124 and/or to define the rotational axis, the upper portion 764*i* of the divergence adjustment input 264*b* (i.e., from which the lever 664*g* extends radially) may mate with a complementary portion of the upper side of the housing 124. For example, the divergence adjustment input 264*b* and the upper side of the housing 124 may include complementary flanges 764*k*, 724*a*, respectively, that are circular and extend radially to interface with each other. A washer 770, which made from a friction reducing material, may be arranged between interfacing portions of the lower side of the upper portion 764*i* of the divergence adjustment input 264*b* and the upper side of the housing 124 (e.g., on an upper surface of the flange 724*a* that engages a bottom surface of a channel in the upper portion 764*i* of the divergence adjustment input 264*b* defined by the flange 764*k*). Instead of or in addition to the flanges 764*k*, 724*a* radially constraining the divergence adjustment input 264*b* and/or defining the rotational axis, a middle portion 764*j* of the divergence adjustment input 264*b* may define a circular outer periphery that engages the inner periphery of a circular bore 724*b* of the housing 124. A seal 772, such as an O-ring seal, may be arranged between surfaces the middle portion 764*j* (e.g., in a circumferential channel thereof) and the circular bore 724*b* in order to prevent water from entering the interior of the housing 124. The bottom protrusion 664*h* extends downward from the middle portion 764*j* of the divergence adjustment input 264*b*.

The divergence adjustment input 264*b* is constrained axially relative to the housing 124 about the rotational axis of the divergence adjustment input 264*b*. For example, a clip 774 (e.g., a C-clip or an E-clip) may be received in a circumferential channel of the middle portion under a lower surface of the upper side of the housing 124. The divergence adjustment input 264*b* is thereby constrained with the upper side of the housing 124 being arranged between the upper portion 764*i* of the divergence adjustment input and the clip 774. The rotational axis of the divergence adjustment input 264*b* is generally perpendicular to the illuminator beam axis.

Referring to FIG. 7B, as referenced previously, the adjustment mechanism 264*c* is configured to move the adjustable optic 264*a* axially along the illuminator beam axis. The adjustment mechanism 264*c* is coupled to the movable bezel 664*f* in which the adjustable optic 264*a* is coupled. As referenced previously, the movable bezel 664*f* moves axially within the second optical chassis 168.

The adjustment mechanism 264*c* is coupled to an upper side of the movable bezel 664*f*, for example, with a threaded fastener 776. The threaded fastener 776 extends through an aperture of the adjustment mechanism 264*c* and an axial slot 768*a* in an upper side of the second optical chassis 168 to be received by and couple to the movable bezel 664*f* The threaded fastener 776 also extends through a spacer 778 that, itself, extends through the adjustment mechanism 264*c* and the axial slot 768*a*. The spacer 778 is compressed between a head of the threaded fastener 776 and an upper surface of the movable bezel 664*f*. The spacer 778 includes a radially extending flange spaced apart from the movable bezel 664*f* sufficiently to prevent excessive friction (e.g., binding) between the adjustment mechanism 264*c* and the second optical chassis 168 (e.g., an upper surface thereof). As the divergence adjustment input 264*b* is rotated to move the adjustment mechanism 264*c*, the threaded fastener 776 and the spacer 778 translate through the axial slot 768*a* and the movable bezel 664*f*, including the adjustable optic 264*a*, is translated axially within the second optical chassis 168.

Figure 9:
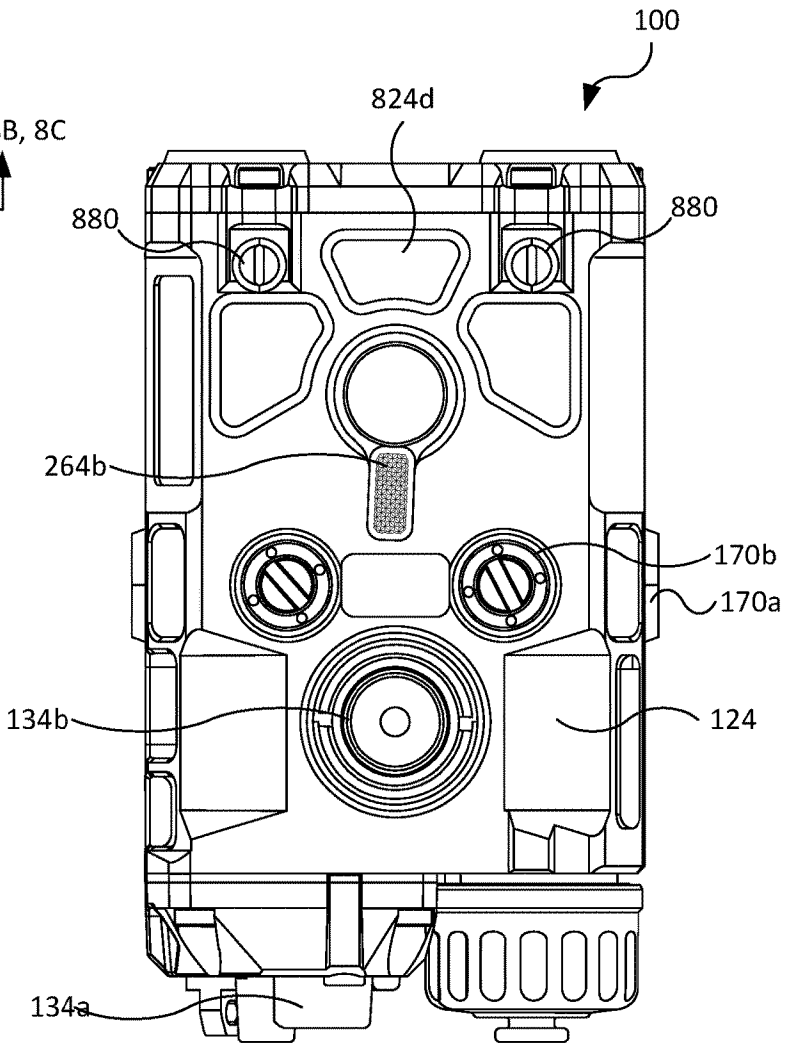
FIG. 9 is a top view of the aiming device.
Figure 8A:
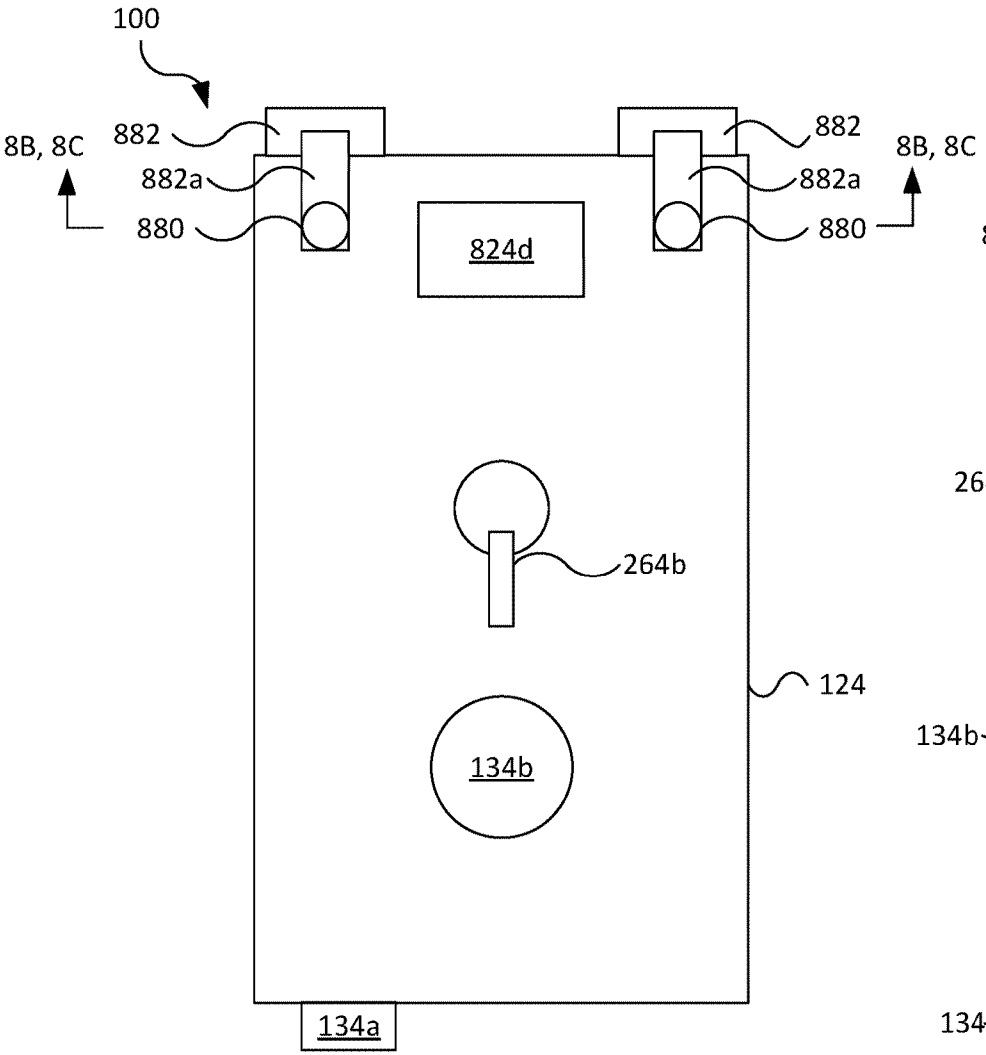
FIG. 8A is a simplified top view of the aiming device.

Referring to FIGS. 8A to 9, the aiming device 100 is further configured to include various attachments on or proximate to a front side thereof. More particularly, the aiming device 100 includes attachment posts 880 on the upper side and a lower side (see e.g., FIG. 5; shown, not labeled) of the housing 124, which may be used to attach covers 882 over the visible laser optics 144, the infrared laser optics 154, and/or the adjustable optical system 164. The covers 882 may, for example, block all light emitted or include filters that filter the light emitted by the visible light laser 142, the near infrared laser 152, and/or the near infrared light source 162 (e.g., to selectively prevent emission of light that may be harmful to eyes, output light at a desired wavelength, and/or such that the light emitted thereby may help others identify the user of the aiming device 100, for example, by outputting the light in an identifiable pattern, such as a shape). The cover 882 is attached to the aiming device 100 with elastic portions 882*a* that extend to the attachment posts 880 on the upper side and the lower side of the housing and which include apertures (not shown) that are received over a head of one of the attachment posts 880. The elastic portions 882*a* are, thereby, positioned and held between a surface of the housing 124 and the head of the attachment post 880.

The attachment posts 880 may be configured to, instead of or in addition to attaching the cover 882, directly attach a secondary aiming device 884 (e.g., an iron sight) or an adapter (not shown) for indirect attachment of another secondary aiming device (not shown, such as a mini red dot sight) to the aiming device 100. For example, referring to FIGS. 8B and 8C, the attachment posts 880 on the upper side of the housing 124 may be configured as threaded fasteners that are removable from threaded apertures 824*c* in the housing 124. The threaded apertures 824*c* may be configured as threaded blind holes that are sealed to an interior of the housing 124 to prevent water intrusion. Referring to FIG. 8B, in the case of attaching only the cover 882, the threaded fastener may have a relatively short length, which only accounts for the elastic portion 882*a* of the cover 882 being between the head of the threaded fastener and the upper side of the housing 124. Referring to FIG. 8C, in the case of attaching the cover 882 and the secondary aiming device 884, the threaded fastener may have a relatively long length, which accounts for both the elastic portion 882*a* of the cover 882 and a mounting portion 884*a* of the secondary aiming device 884 being between the head of the threaded fastener and the upper side of the housing 124.

The upper side of the housing 124 additionally includes a locating feature 824*d*, which is configured to positively locate and/or orient the secondary aiming device 884 or the adapter to the housing 124. The locating feature 824*d* may, as shown, be configured as a recess (e.g., a depression) in the upper side of the housing 124. The secondary aiming device 884 (or the adapter) includes a corresponding locating feature 884*b* that mates with the locating feature 824*d* of the housing 124 (e.g., being received therein), so as to position the secondary aiming device 884 (or the adapter) in a predetermined arrangement (i.e., position and orientation) relative to the housing 124. The locating features 824*d*, 884*b* are configured (e.g., shaped) relative to each other and in conjunction with the attachment posts 880 and the mounting portion 884*a* to prevent relative movement (i.e., translation and rotation) between the secondary aiming device 884 and the aiming device 100.

Figure 8D:
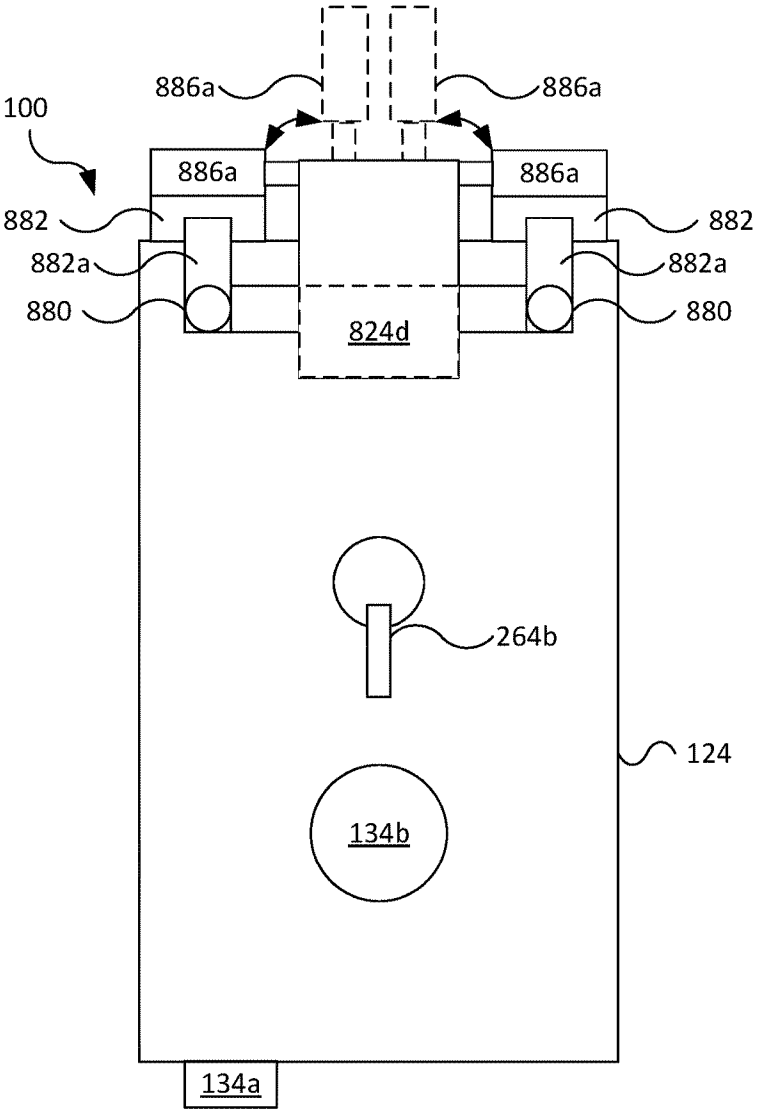
FIG. 8D is a simplified top view of the aiming device having a cover device 886 coupled thereto.
Figure 8B:
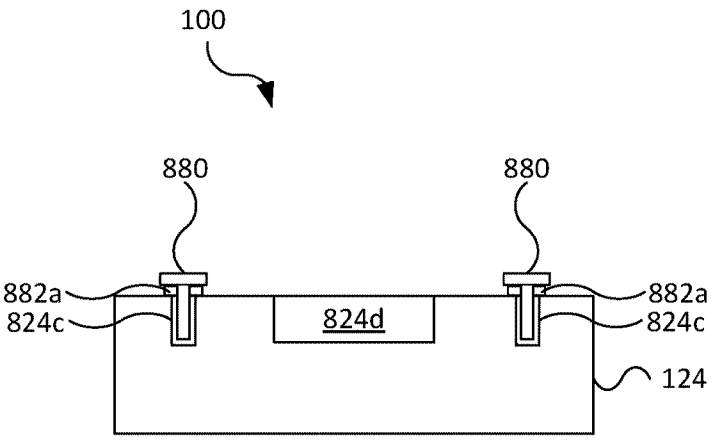
FIG. 8B is a cross-sectional view of the aiming device taken along line 8B-8B without a secondary aiming device.
Figure 8C:
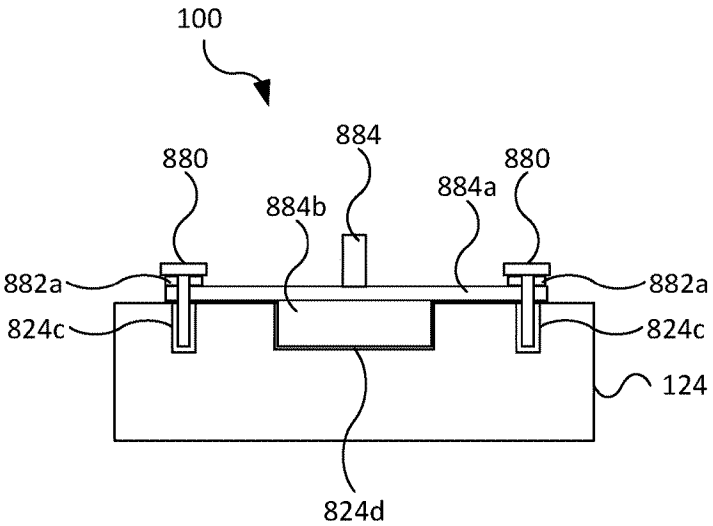
FIG. 8C is a cross-sectional view of the aiming device taken along line 8C-8C with a secondary aiming device attached thereto.

Referring to FIG. 8D, in another example, a cover device 886 may be mounted to the aiming device 100 via the attachment posts 880 and the locating feature 824*d*, as described for the secondary aiming device 884 (e.g., including the mounting portion 884*a* and the locating feature 884*b*). The cover device 886 may include one or more covers 886*a* that are movable relative to the mounting portion 884*a* and, thereby, the aiming device 100 between a stowed or non-use position (dashed lines) and a use position (solid lines).

The one or more covers 886*a* may be configured, for example, as described previously with respect to the visible light laser 142, the near infrared laser 152, and/or the near infrared light source 162 (e.g., to block all light, filter light to prevent harmful wavelengths, filter light to output a desired wavelength, and/or output light in an identifiable pattern). The covers 886*a* may be used alone or in conjunction with the covers 882.

As shown, the covers 886*a* are movable between and retained in the stowed position and the use position, for example, by a pivoting motion about one or more substantially vertical axes (as shown), longitudinal axes (i.e., in the direction in which light from the visible light laser 142 is emitted), or transverse axes (i.e., generally horizontal and perpendicular to the direction in which light is emitted from the visible light laser 142). For example, the covers 886*a* may be coupled to and extend from arms (shown; not labeled) that are pivotably coupled to the mounting portion 884*a*. The covers 886*a* may be retained in the stowed and/or use positions in any suitable manner, for example, with detents, magnets, springs, or combinations thereof. In the use position, the covers 886*a* may be positioned adjacent (e.g., ahead of) and, may further contact, one of the covers 882 or portions of the housing 124 surrounding the regions through which light is emitted by the visible light laser 142, the near infrared laser 152, and/or the near infrared light source 162.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. An aiming device for a firearm comprising:

a housing; and a near infrared illuminator positioned in the housing and configured to output a beam of near infrared light with beam divergence that is adjustable to provide a field of illumination that is adjustable;

wherein the near infrared illuminator includes a divergence adjustment input positioned on an upper side of the housing that is movable by a user to adjust the beam divergence;

wherein the aiming device is configured to mount to a firearm; and wherein the divergence adjustment input includes a lever that is rotatable about a rotational axis that is generally perpendicular to a beam illuminator axis of the beam of near infrared light.

2. The aiming device according to claim 1, further comprising a visible aiming laser, a near infrared aiming laser, and an on-device actuation input that is configured to receive an input from the user to operate the near infrared illuminator, the visible aiming laser, and the infrared aiming laser, the on-device actuation input being located on the upper side of the housing;

wherein the divergence adjustment input and the on-device actuation input are both centrally-located on the upper side of the housing between a left side and a right side of the housing; and wherein the divergence adjustment input includes a lever that is rotatable in a range of motion of between approximately 90 and 180 degrees to adjust the beam divergence, and the range of motion of the lever is substantially symmetric about a line parallel with an axis of the beam of the near infrared light.

3. The aiming device according to claim 1, wherein the divergence adjustment input is centrally-located on the upper side of the housing between a left side and a right side of the housing.

4. The aiming device according to claim 1, wherein the divergence adjustment input includes a lever that is rotatable to adjust the field of illumination in a range of motion of between approximately 90 and 180 degrees.

5. The aiming device according to claim 4, wherein the range of motion of the lever is substantially symmetric about a line parallel with an axis of the beam of the near infrared light.

6. The aiming device according to claim 4, wherein the lever is configured to be moved by a single finger of the user without being grasped.

7. The aiming device according to claim 1, further comprising an on-device actuation input that is configured to receive an input from the user to operate the near infrared illuminator, the on-device actuation input being located on the upper side of the housing.

8. The aiming device according to claim 7, wherein the divergence adjustment input and the on-device actuation input are both centrally-located on the upper side of the housing between a left side and a right side of the housing.

9. The aiming device according to claim 7, wherein the aiming device includes no other physical input on the upper side of the housing that is operable without a tool.

10. The aiming device according to claim 1, wherein further comprising a photodiode according to which the near infrared illuminator is operated to output a beam of the near infrared light with a desired output power.

11. The aiming device according to claim 10, wherein the near infrared illuminator includes a near infrared light source and a control system having the photodiode, and the control system regulates input power to the near infrared light source to output the beam of the near infrared with the desired output power according to the photodiode.

12. The aiming device according to claim 10, further comprising a visible aiming laser and a second photodiode according to which the visible aiming laser is operated, and a near infrared aiming laser and a third photodiode according to which the near infrared aiming laser is operated.

13. An aiming device for a firearm comprising:

a visible light aiming laser that outputs a beam of visible light;

an infrared aiming laser that outputs a first beam of near infrared light that is aligned with the beam of visible light;

an infrared illuminator that outputs a second beam of near infrared light with beam divergence that is adjustable;

a chassis having a base and a housing coupled to the base, the base being configured to mount to the firearm and the housing containing the visible light aiming laser, the infrared aiming laser, and the infrared illuminator;

a divergence adjustment input configured to receive a user input for adjusting the beam divergence of the second beam of near infrared light, the divergence adjustment input including a slide that is movable to receive the user input;

an on-device actuation input configured to receive another user input to operate the visible light aiming laser, the infrared aiming laser, and the infrared illuminator wherein the slide is positioned on an upper side of the housing and is movable in a plane; and wherein the plane is generally parallel with a beam illuminator axis of the beam of near infrared light.

14. The aiming device according to claim 13, wherein the slide is a lever that is rotatably movable to receive the user input, the on-device actuation input is a button that is pressable to receive the other user input, and the lever and the on-device actuation input are centrally positioned on an upper side of the housing away from the base with the on-device actuation input being positioned toward a user relative to the lever;

wherein the infrared illuminator includes a light source, an adjustable optic that is movable relative to the light source to adjust the beam divergence, and an adjustment mechanism that extends between the divergence adjustment input and the adjustable optic to transfer force and movement therebetween to adjust the beam divergence; and wherein the divergence adjustment input includes an upper portion with the slide configured as a rotatable lever, a middle portion that extends from the upper portion through the upper side of the housing, and a lower portion that extends into the housing and is radially offset relative to a rotational axis of the divergence adjustment input, the adjustment mechanism being coupled to the lower portion of the divergence adjustment input and the adjustable optic of the infrared illuminator.

15. The aiming device according to claim 13, wherein the slide is a lever that is rotatably movable.

16. The aiming device according to claim 15, wherein the on-device actuation input is a button that is pressable to receive the other user input.

17. The aiming device according to claim 15, wherein the lever and the on-device actuation input are centrally positioned on an upper side of the housing away from the base with the on-device actuation input being positioned toward a user relative to the lever.

18. The aiming device according to claim 13, wherein the infrared illuminator includes a light source, an adjustable optic that is movable relative to the light source to adjust the beam divergence, and an adjustment mechanism that extends between the divergence adjustment input and the adjustable optic to transfer force and movement therebetween to adjust the beam divergence.

19. The aiming device according to claim 18, wherein the divergence adjustment input includes an upper portion with the slide configured as a rotatable lever, a middle portion that extends from the upper portion through the upper side of the housing, and a lower portion that extends into the housing and is radially offset relative to a rotational axis of the divergence adjustment input, the adjustment mechanism being coupled to the lower portion of the divergence adjustment input and the adjustable optic of the infrared illuminator.

20. The aiming device according to claim 18, further comprising a photodiode according to which the light source is operated to output the second beam of the near infrared light with a desired power.

21. The aiming device according to claim 13, wherein the slide is translationally movable.

22. The aiming device according to claim 21, wherein the slide is movable one of left-to-right or fore-aft.

* * * * *